US011466892B2

(12) United States Patent
Carey et al.

(10) Patent No.: US 11,466,892 B2
(45) **Date of Patent: *Oct. 11, 2022**

(54) BACKDRAFT DAMPER HAVING DAMPER BLADES WITH OPPOSED MOVEMENT LINKAGE

(71) Applicant: T. A. Morrison & Co Inc., Stittsville (CA)

(72) Inventors: Stephen Dane Carey, LaVergne, TN (US); Ron Chappell, Stittsville (CA)

(73) Assignee: T. A. Morrison & Co Inc., Stittsville (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/030,656

(22) Filed: Sep. 24, 2020

(65) Prior Publication Data

US 2021/0018217 A1 Jan. 21, 2021

Related U.S. Application Data

(63) Continuation of application No. 16/104,779, filed on Aug. 17, 2018, now Pat. No. 10,816,237.

(Continued)

(51) Int. Cl.

| | |
|---|---|
| ***E06B 7/086*** | (2006.01) |
| ***F24F 13/15*** | (2006.01) |
| ***F24F 13/14*** | (2006.01) |

(52) U.S. Cl.

CPC ..... *F24F 13/15* (2013.01); *F24F 13/1426* (2013.01); *F24F 13/1486* (2013.01); *F24F 2013/146* (2013.01); *F24F 2013/1473* (2013.01)

(58) Field of Classification Search

CPC ..... F24F 13/15; F24F 13/1426; F24F 13/1486

(Continued)

(56) References Cited

U.S. PATENT DOCUMENTS 2,954,728 A * 10/1960 Smith ..... A62C 2/14 49/1
3,029,772 A * 4/1962 Thompson ..... H03J 1/045 116/246

(Continued)

FOREIGN PATENT DOCUMENTS

GB 625798 A * 7/1949 ..... F24F 13/15
WO WO-2011123087 A1 * 10/2011 ..... F24F 13/15

*Primary Examiner* — Jerry E Redman
(74) *Attorney, Agent, or Firm* — Kevin Shipley; Marks & Clerk

(57) ABSTRACT

A backdraft damper for permitting a flow of air in an outflow direction and preventing the flow of air in a backdraft direction, including a frame having a transverse opening allowing the passage of air through the frame; a plurality of blades, each blade extending across the frame and mounted to the frame about a central portion by pivot members, for rotation between an open position in which the blade allows air to flow through the frame and a closed position in which the blade blocks air from flowing through the frame, the plurality of blades including one or more first blades arranged to rotate in a first direction from the closed position to the open position; one or more second blades arranged to rotate in a second direction opposite to the first direction from the closed position to the open position; the backdraft damper further including a linkage between the one or more first blades and the one or more second blades to cause the first and second blades to together rotate between the closed and open positions; and the one or more second blades being more balanced about respective pivot members than the one or more first blades thereby to permit the one or more first blades to bias the entire plurality of blades to the closed position while being movable to the open position by the force of air flowing through the frame in the outflow direction.

15 Claims, 8 Drawing Sheets

Related U.S. Application Data

(60) Provisional application No. 62/546,904, filed on Aug. 17, 2017.

(58) Field of Classification Search
USPC ..... 49/77.1, 87.1, 89.1
See application file for complete search history.

(56) References Cited

U.S. PATENT DOCUMENTS 3,044,387 A * 7/1962 Hinden ..... F24F 13/15 49/77.1
3,055,284 A * 9/1962 Pellegrini ..... F24F 13/15 49/91.1
3,204,548 A * 9/1965 Mccabe ..... F24F 13/15 454/352
3,267,962 A * 8/1966 Josephson ..... F24F 13/15 137/601.11
3,275,031 A * 9/1966 Alyea ..... F24F 13/15 137/601.06
3,464,341 A * 9/1969 Dobrin ..... F24F 13/1413 454/336
3,484,990 A * 12/1969 Elliot ..... F16K 1/165 49/91.1
3,604,458 A * 9/1971 Silvey ..... F16K 1/165 137/601.11
3,771,559 A * 11/1973 Alley ..... F16K 1/165 137/601.06
3,793,932 A * 2/1974 Tarnoff ..... F24F 13/15 454/335
3,885,347 A * 5/1975 Adachi ..... F24F 13/15 49/91.1
3,908,529 A * 9/1975 McCabe ..... F24F 13/15 454/359
3,926,102 A 12/1975 De Lepeleire
3,982,560 A 9/1976 Dibert
4,081,173 A * 3/1978 McCabe ..... F24F 13/15 137/601.05
4,113,230 A * 9/1978 McCabe ..... F24F 13/15 137/601.08
4,241,539 A * 12/1980 Josephson ..... E06B 7/086 454/336
4,241,647 A * 12/1980 Herr ..... F24F 13/1413 137/601.11
4,256,143 A * 3/1981 Magill ..... F24F 13/15 137/601.06
4,305,427 A * 12/1981 Josephson ..... F24F 13/15 137/601.09
4,372,342 A * 2/1983 McCabe ..... F24F 13/1426 126/295
4,513,655 A * 4/1985 Dayus ..... F24F 13/1486 454/318
4,518,012 A * 5/1985 O'Hara ..... F24F 13/15 137/601.09
4,541,328 A * 9/1985 Brzezinski ..... F24F 13/15 454/336
4,655,122 A * 4/1987 McCabe ..... F24F 13/15 137/512.1
4,887,641 A * 12/1989 Alley ..... F16K 1/165 137/601.09
5,277,658 A * 1/1994 Goettl ..... F24F 11/043 137/512.1
5,732,507 A * 3/1998 Edwards ..... E04B 7/163 49/74.1
6,181,557 B1 * 1/2001 Gatti ..... H05K 7/20618 165/122
7,582,009 B1 * 9/2009 Cote ..... F24F 11/75 454/264
8,897,009 B2 * 11/2014 Janes ..... H05K 7/20909 361/695
9,574,789 B2 * 2/2017 Enke ..... F24F 13/1413
10,125,622 B2 * 11/2018 Rice ..... F04D 29/563
10,816,237 B2 * 10/2020 Carey ..... F24F 13/15
2016/0265806 A1 * 9/2016 Chappell ..... F24F 13/1413
2017/0097171 A1 * 4/2017 Cermak ..... F24F 13/075
2019/0056141 A1 * 2/2019 Carey ..... F24F 13/15
2019/0257549 A1 * 8/2019 Koeger ..... F16K 31/34
2021/0018217 A1 * 1/2021 Carey ..... F24F 13/1426

* cited by examiner 54
76
78
72
75b
74
50
72a
75a
74a
75
82
74b
80
70
82a
16
30

BACKDRAFT DAMPER HAVING DAMPER BLADES WITH OPPOSED MOVEMENT LINKAGE

CROSS-REFERENCE TO RELATED APPLICATION

This application is a continuation of U.S. Pat. No. 10,816,237 filed Aug. 17, 2018 which claims the benefit of 35 USC 119 based on the priority of U.S. Provisional Patent Application 62/546,904, filed Aug. 17, 2017 and entitled Backdraft Damper Having Damper Blades With Opposed Movement Linkage, each application being incorporated herein in its entirety by reference.

FIELD

This invention relates to airflow dampers. In particular the invention relates to backdraft dampers.

BACKGROUND

U.S. Pat. No. 3,982,560 relates to an apparatus for introducing fresh, outside air to a forced air heating or cooling system of buildings comprising a conduit for conducting fresh air to the system, a damper movably mounted in the conduit for adjusting the flow of fresh air therein, and a counterweight adjustably mounted on the damper inside the conduit for movement to selected counterbalancing positions.

US Patent Publication No. 2017/0097171 relates to a fan damper having a frame and a plurality of hollow airfoil blades, each having a leading edge, a trailing edge, a seal formed on the trailing edge, and a pivot mechanism on either end of each blade, each of which pivot mechanisms includes an extension that includes a weight. A secondary seal is positioned between the pivot mechanisms and the sides of the frame. A ladder bar connects the pivot mechanisms. During significant air pressure changes, such as when a fan is turned on, the airfoil blades are caused to move, against the weights from a first, closed, overlapping position relative to the frame, whereupon the seal on the trailing edge of a relatively upper blade seals against the leading edge of an adjacent relatively lower blade, and the secondary side frame seal seals against the pivot mechanisms, to a second, open position. The airfoil blades will stay in the open position as long as the air pressure is enough to overcome the effect of the weights. When the air pressure decreases sufficiently, the blades return to the closed, overlapping position.

US Patent Publication No. 2016/0265806 relates to a backdraft damper for permitting a flow of air in an outflow direction and preventing the flow of air in a backdraft direction has a frame provided with a transverse opening allowing the passage of air through the frame. One or more blades extend across the frame and are mounted to the frame about a central portion by pivot members, for rotation between open and closed positions. Each blade comprises a blade body having a leading portion upstream of the central portion, the leading portion of the blade body comprising a channel, a trailing portion downstream of the central portion, the trailing portion of the blade having a larger surface area than the leading portion and comprising a seal disposed adjacent to a distal edge of the trailing portion, for sealing against either the leading portion of an adjacent blade or a blade stop projecting from the frame, and a counterweight disposed in the channel, whereby the counterweight balances the blade such that the blade is biased to the closed position by gravity and movable to the open position by the force of air flowing through the frame in the outflow direction.

SUMMARY

In accordance with one aspect of the invention, there is provided a backdraft damper for permitting a flow of air in an outflow direction and preventing the flow of air in a backdraft direction, comprising a frame having a transverse opening allowing the passage of air through the frame; a plurality of blades, each blade extending across the frame and mounted to the frame about a central portion by pivot members, for rotation between an open position in which the blade allows air to flow through the frame and a closed position in which the blade blocks air from flowing through the frame, the plurality of blades comprising: one or more first blades arranged to rotate in a first direction from the closed position to the open position; one or more second blades arranged to rotate in a second direction opposite to the first direction from the closed position to the open position; the backdraft damper further comprising: a linkage between the one or more first blades and the one or more second blades to cause the first and second blades to together rotate between the closed and open positions; and the one or more second blades being more balanced about respective pivot members than the one or more first blades thereby to permit the one or more first blades to bias the entire plurality of blades to the closed position while being movable to the open position by the force of air flowing through the frame in the outflow direction.

In an embodiment, the one or more second blades are arranged below the one or more first blades in the frame.

In an embodiment, a counterweight is associated with each of the one of more second blades.

In an embodiment, the damper comprises a plurality of second blades, wherein a counterweight is associated with only one of the second blades.

In accordance with another aspect of the teachings described herein, a backdraft damper for permitting a flow of air in an outflow direction and preventing the flow of air in a backdraft direction can include a frame having an interior that is bounded by a first end, a second end spaced from the first end and opposing side panels extending between the first and second ends, the frame defining an air inlet and an air outlet spaced apart from the air inlet in an outflow direction. An airflow region may extend between the air inlet and air outlet. one or more first blades may extend along a first blade axis and may be pivotally mounted to the frame within the airflow region. The first blades may be and rotatable in a first rotation direction about a first pivot axis from an open position in which the blade allows air to flow through the frame and a closed position in which the first blade inhibit airflow through the airflow region from flowing through the frame. One or more second blades may be pivotally mounted to the frame within the airflow region and rotatable in a second rotation direction about a second pivot axis from an open position in which the blade allows air to flow through the frame and a closed position in which the first blade inhibit airflow through the airflow region from flowing through the frame. The second rotation direction may be different than the first rotation direction. A linkage between the one or more first blades and the one or more second blades may allow the first and second blades to rotate together rotate between the respective closed and open positions.

A first one of the first blades may extend along a first blade axis and may have a first blade length that is orgontonal to the blade axis. When the first blades and second blades are in their repspective open positions the first one of the first blades may be spaced apart from an adjacent one of the second blades by a blade offset distance that is greater than the first blade length.

When the first blades and second blades are in their repspective open positions an intermediate flow region may be defined between the first one of the first blades and the adjacent one of the second blades. The intermediate flow region may be substantially unobstructed by the first blades and second blades and may have a height in a direction orthogonal to the first blade axis and first blade length that is substantially equal to the blade offset distance.

When the first blades are in a partially open position between the open position and the closed position air flowing through the damper may be re-directed in a first flow direction by the first blades and in a second flow direction by the second blades that is different than the first flow direction.

When the first blades are in a partially open position between the open position and the closed position air flowing in the first flow direction may flow generally toward the second blades.

The frame may define a central air flow axis that is parallel to the outflow direction. When the first blades are in a partially open position between the open position and the closed position air flowing in the first flow direction may flow generally toward the central flow axis.

When the second blades are in a partially open position between the open position and the closed position air flowing in the second flow direction may flow generally toward the central flow axis.

Air travelling in the first flow direction may converge with air travelling in the second flow direction at a location that is either within the intermediate flow region or downstream from the damper, thereby forming a composite air flow travelling substantially in the outflow direction.

The first blades and second blades may each include a blade body portion having the same, extruded cross-sectional shape.

Each the first blades and second blades may each include a counterweight receiving portion that is integrally molded into the blade body portion. A counterweight member may be provided in the counterwieght receiving portion of at least one of the second blades.

At least one of the second blades may be weighted so as to be unbalanced and biased to rotate toward its closed position.

Each of the first blades may be configured to produce a first moment about its respective first pivot axis. At least one of the second blades may be configured to produce a second moment about its respective second pivot axis that is greater than the first moment.

BRIEF DESCRIPTION OF THE DRAWINGS

In drawings which illustrate by way of example only a preferred embodiment of the invention.

DETAILED DESCRIPTION

Figure 1A:
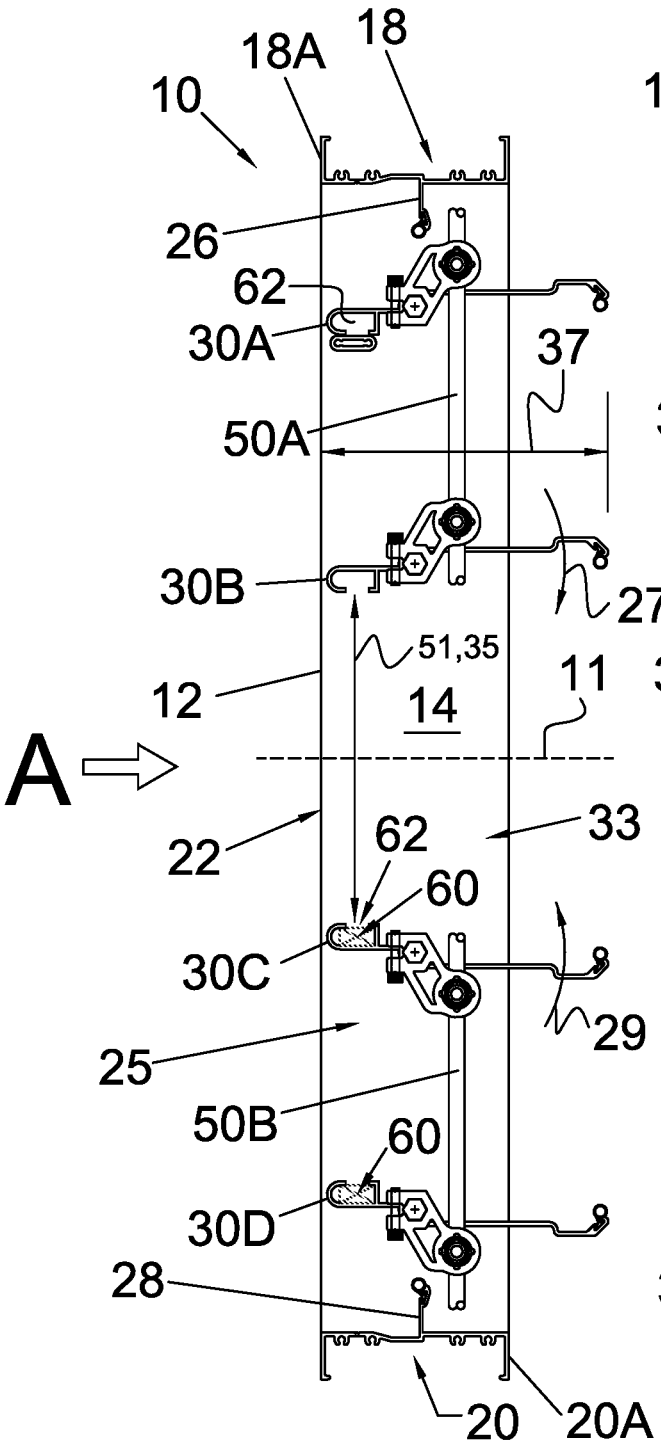
FIG. 1A is a first side view of a backdraft damper according to the invention, shown in open position.

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors, or owners do not intend to abandon, disclaim, or dedicate to the public any such invention by its disclosure in this document.

Backdraft dampers can be used to allow air to flow through the damper in one direction, an outflow direction while inhibiting and/or preventing the flow of air in the opposing direction as a backdraft or backflow of air. These dampers can be used in various industrial and commercial heating, ventilating and air conditioning (HVAC) systems, in which it is desired to allow air to flow in one direction (e.g. from inside a building to outside a building) while inhibiting counterflow (e.g. from outside to inside the building).

Some such dampers can include an outer frame sized to either fit into a specified opening or to cover a specific opening, in various environments. The dampers typically include one or more damper blades that can be movable from an open position in which air is permitted to flow through the damper frame in one direction, and a closed position blocking the flow of air through the damper frame, which may, for example, help prevent the contamination of air within a premises and/or the ingress of thermally unfavourable air (warm or cold) into a thermally controlled premises.

Preferably, a backdraft damper may work automatically, such that its damper blades can be moved from their closed position to their open position under the force of flowing air, without the need for other actuators or energy inputs. Optionally, the backdraft damper can also be arranged so that is blades can move from the open position to their closed position without an external actuator. In some arrangements, the blades may tend to be urged closed by a flow of air attempting to pass through the damper in the backflow direction. Alternatively, or in addition, the blades may be biased toward the closed position using a biasing member (such as a spring, etc.) and/or may be weighted such that they tend to rotate toward the closed configuration under the influence of gravity (and/or a combination of these or other mechanisms). That is, flowing air either in the intended (outflow) direction, in which the airflow maintains the backdraft blades in an open condition, or in the reverse (backdraft) direction in which the loss of outflow air causes the backdraft blades to move to the closed position under the influence of gravity or reversed airflow, and the backdraft maintains the blades in the closed position for the duration of the backdraft current.

However, with the blades being biased toward their closed position, some of the force of the air flowing in the outflow direction may be sacrificed/consumed to maintain the damper blades in the open position, which may reduce the desired airflow of the outflow current.

HVAC systems may be typically carefully designed to distribute air evenly about a premises, and reductions in airflow can have an effect of skewing the pressure distribution to some flow-paths over others, reducing the intended airflow rates to some parts of the premises.

One solution to this is to try and balance the blades about their respective pivot rods so that little force is required to open them. However, this can cause inadvertent leakage in the backdraft direction in some configurations, which may result in lower efficiency where the backdraft damper is providing thermal protection. This may also lead to situations where the backdraft damper is preventing the potential ingress of toxic or noxious gasses that can result in a serious risk to occupants of the premises.

It would accordingly be advantageous to provide a backdraft damper having blades which are biased to the closed position with sufficient force to prevent the blades from remaining open when the outflow current is disrupted, but which can be opened with a relatively low force without impeding the airflow through the damper and thus without losing pressure to maintaining the damper in the open position.

United States Patent Application Publication No. 2016/0265806 to Chappell et al., filed on Mar. 9, 2015 entitled "COUNTERWEIGHTED BACKDRAFT DAMPER BLADE WITH IMPROVED AIRFLOW PROFILE", the contents of which are incorporated herein by reference, discloses configurations of counterweighted damper blades that are profiled so as to streamline the flow of air through the damper when in the open position thereby to maintain the damper in the open position with little backpressure, while biasing the blades of the damper to their closed position. The configurations disclosed in the '806 patent application are effective, but there remains a desire for improved improvement backdraft dampers.

In known dampers, the blades are generally arranged to rotate about some type of pivot joint/rod and are generally arranged such that all of the blades rotate in the same direction. As air passes through the damper its direction can be influenced by engagement with the blades, which can alter the direction of the air flow. If the blades are fully in their open position they can, in some configurations, extend generally in the airflow direction such that their influence on the air flow direction is reduced (i.e. the air may tend to continue flowing substantially parallel to the air flow direction). When the blades are partially open, i.e. partially rotated between their closed position (generally orthogonal to the airflow direction) and their opening position (generally parallel to the airflow direction) they can tend to interfere with the air flow more significantly, and can alter the direction of the air as it passes through the damper. In conventional dampers, the blades tend to rotate "upwardly" when they are opening, and therefore may tend to direct the airflow in an opposing direction (generally downwardly) as the air engages the blades. More generally, with blades arranged to open in a common direction, conventional dampers tend to re-direct the incoming airflow toward one end of the damper frame (typically the bottom) when the blades are in their partially opened positions. Such re-direction of the airflow can result in generally undesirable flow conditions, including changes to the backpressure, turbulence and energy loss.

In contrast to convention dampers, backdraft dampers in accordance with the teachings described herein can be configured to include at least two sets of blades that are configured to operate differently from each other. For example, a damper may include a first set of blades (having one or more individual blades) that are arranged so that they are rotatable in a first direction relative to the damper frame when moving from their closed position to their open position. The damper may also include a second set of blades (having one or more individual blades) that are arranged so that they are rotatable in an opposing, second direction when moving from their closed position to their open position. In this arrangement, when the first and second set of blades are each in a partially open position (i.e. inclined relative to the airflow direction) the first and second set of blades will be inclined at different angles relative to the airflow direction/axis. This may cause air that contacts the first set of blades to be re-directed in a first direction, while air that contacts the second set of blades may be re-directed in a different, second direction. For example, the first blades could be configured such that air contacting the partially-open first blades tends to be directed toward an upper end of the frame, and optionally the second blades could be configured such that air contacting the partially-open second blades tends to be directed toward a lower end of the frame. This may have the effect of generally splitting the air flow as it passes through the damper.

Alternatively, the first and second blades can be arranged so that air contacting the partially-open first blades tends to be directed toward the middle of the airflow region (i.e. toward the middle of the frame), and the second blades could also be configured such that air contacting the partially-open second blades tends to be directed toward the middle of the airflow region. This may also mean, in some configurations, that air re-directed by the first set of blades tends to travel toward the second set of blades, and vice versa, and also may, in some configurations, result in air that is re-directed by the first set of blades converging with air that is re-directed by the second set blades (i.e. the first direction/axis tends to converge with the second direction/axis).

In some configurations, the convergence, or at least partial convergence of the portions of the air flow engaging the first and second sets of blades toward the middle of the damper frame/air flow region may help facilitate the resultant air flow exiting the damper in approximately the airflow direction, rather than being generally directed toward one end of the damper. This may help reduce the energy loss experienced with convention dampers in which the blades are arranged to re-direct the airflow toward one end of the damper.

Arranging the first and second sets of blades to move/rotate in opposite directions may help provide a flow region that is located between the first and second sets of blades. Such an intermediate flow region may be relatively free of obstruction, as it does not contain the pivot rods or other connecting portions for any of the blades in the damper. It may also be relatively larger (at least in one direction that is orthogonal to the airflow direction) than the flow regions defined between adjacent blades in the first blade set or adjacent blades in the second blade set. This may be at least partially the result of the opposing movement of the first and second blade sets, as the intermediate flow region may be formed when a first blade and a second blade rotate away from each other, in opposite rotation directions.

In some arrangements, the intermediate flow region may be at least partially bounded by a blade from the first set of blades and a blade from the second set of blades, and have a height that is equal to a blade offset distance between the blades. Optionally, the height/blade offset distance may be greater than the length of any one of the blades in the first and second blades.

Optionally, the intermediate flow region may be located toward, or at, the geometric middle of the airflow region for a given damper. Alternatively, the intermediate flow region may be offset toward one side/edge of the airflow region for a given damper.

In some embodiments, this intermediate flow region may also receive air that has been re-directed by the first set of blades and another portion of the air flow stream that has been re-directed by the second set of blades, which may be understood as a hybrid or composite air flow for the purposes of this description. In this arrangement, air flows re-directed by the first and second sets of blades may re-join and/or mix within the intermediate flow region or alternatively downstream from the damper 10.

Figure 1B:
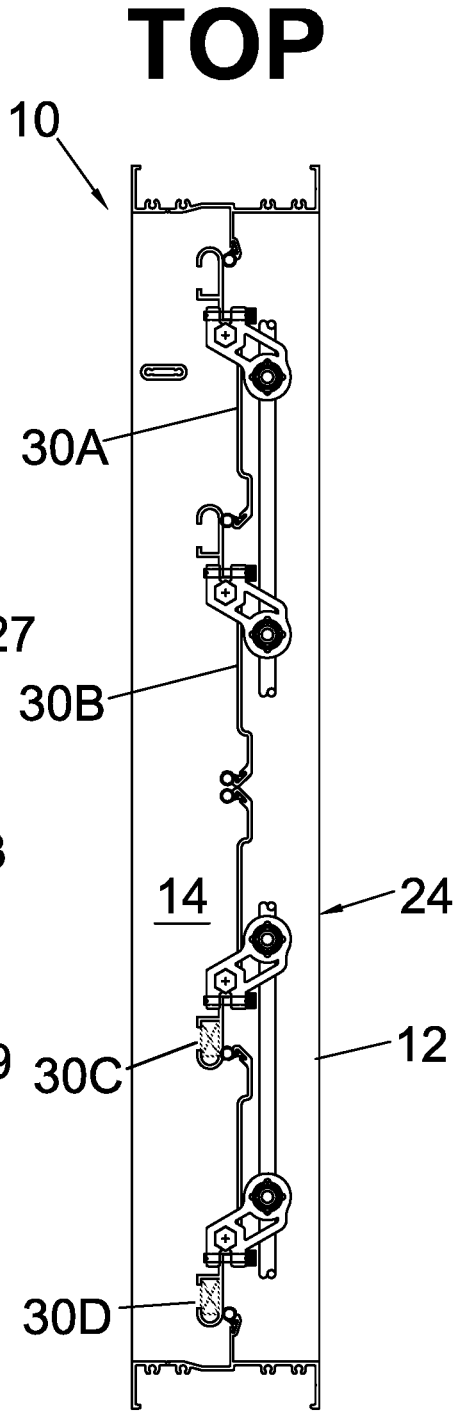
FIG. 1B is a first side view of the backdraft damper of FIG. 1A, shown in closed position.
Figures 2A, 2B:
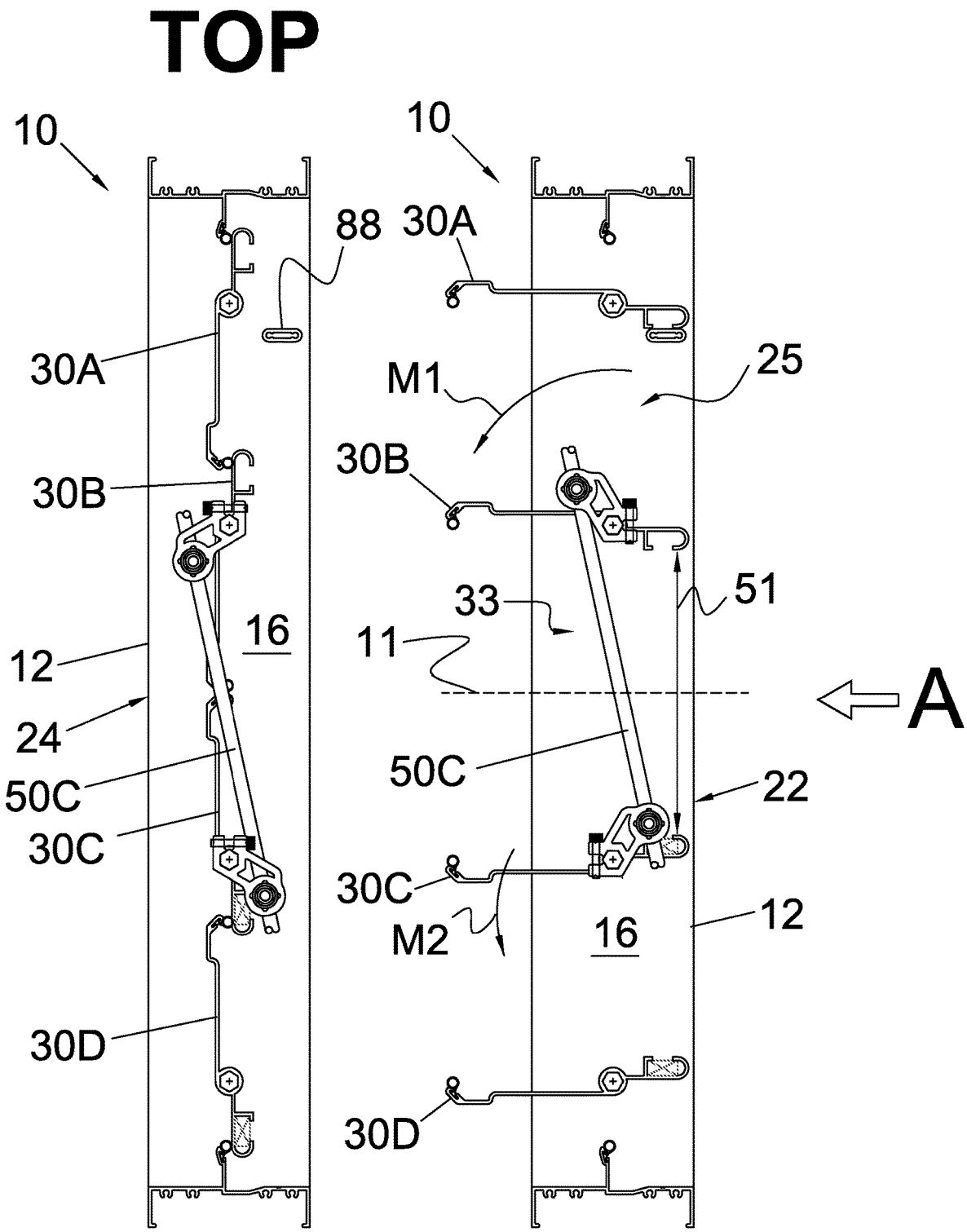
FIG. 2A is a second side view of the backdraft damper of FIG. 1A, shown in closed position.
FIG. 2B is a second side view of the backdraft damper of FIG. 1A, shown in open position.

Referring to FIGS. 1A-2B, one example of a backdraft damper 10 is configured to allow a flow of air in an outflow direction, shown by the airflow axis 11 and arrows "A" in FIGS. 1A and 2B, and preventing the flow of air in the opposite (backdraft) direction. A damper 10 according to this example may be mounted in many different environments, for example to the wall of a plenum or HVAC unit, to a duct, inside a duct, or to the outlet or inlet of a blower as indicated above, and the invention is not limited to any specific environment or application. In some embodiments, the central airflow axis 11 may be generally horizontal (as illustrated), while in other installations it is vertical or is inclined.

The damper 10, or other examples incorporating the aspects of the teachings described herein may include any suitable number of individual blades, and preferably includes at least two sets of blades (which tend to be similarly configured) as explained herein. For example, while the embodiment of the damper illustrated in FIGS. 1A-2B has four blades, with two of those blades opening (closing) in one direction while the other two of those blades are opening (closing) in the opposite direction, the invention may be advantageously implemented in any backdraft damper 10 having two or more blades. Preferably, in a given damper the number of blades opening (closing) in one direction may be the same as the number of blades opening (closing) in the opposite direction, such as for examples: one blade and one blade, two blades and two blades (as described specifically), three blades and three blades, four blades and four blades, and so forth—however other, asymmetrical configurations are possible.

In this example, the damper 10 illustrated includes a generally rectangular frame 12. The frame 12 has opposed sides 14, 16 respectively (with respective sidewalls) providing opposed mounting flanges projecting outwardly, generally in a plane containing the respective front and rear faces 22, 24 of the damper 10. The frame sides 14, 16 are affixed to opposed ends 18, 20 (with corresponding endwalls), each similarly comprising mounting flanges 18*a*, 20*a*, and having blade stops 26, 28 and extending laterally across the respective end 18, 20 of the frame for the purposes described below. The sides 14, 16 may be of any suitable construction, and may, for example, be extruded from any suitable material so as to produce a rigid frame 12 that can resist deformation when the damper 10 is in use, for example 0.05" to 0.25" (1.27 mm to 6.25 mm) aluminium or steel, and joined to the ends 18, 20 of the damper 10 by welding, fasteners (such as metal screws or rivets) or by any other suitable securing means. The ends 18 and 20 may have analogous construction.

The interior of the frame 12 thus defines a transverse opening allowing the passage of air through the frame 12, creating an airflow region 25 extending between the inflow and outflow faces 22, 24. The airflow region 25 is, in this example, bounded by the side panels 14, 16 and the end panels 18, 20, and thus has a cross-section defined by the open area of the faces 22, 24.

Preferably, a plurality of blades can be positioned within the interior of the frame 12 and can be movable relative to the side panels 14, 16 and the end panels 18, 20. The blades can be moveable between a closed orientation in which the blades block the airflow region 25 and inhibit airflow through the damper 10, and an open orientation in which the airflow region 25 is at least partially unblocked, thereby facilitating air flow through the damper 10.

In this example, the damper 10 includes four blades 30A, 30B, 30C and 30D, each of which extend across the airflow region 25 and are mounted to the frame 12 in a manner that will be described below. Preferably, the blades 30A, 30B, 30C and 30D are movable relative to the frame, and more preferably at least some of the blades 30A, 30B, 30C and 30D, can be connected to move in unison with each other.

Figure 4:
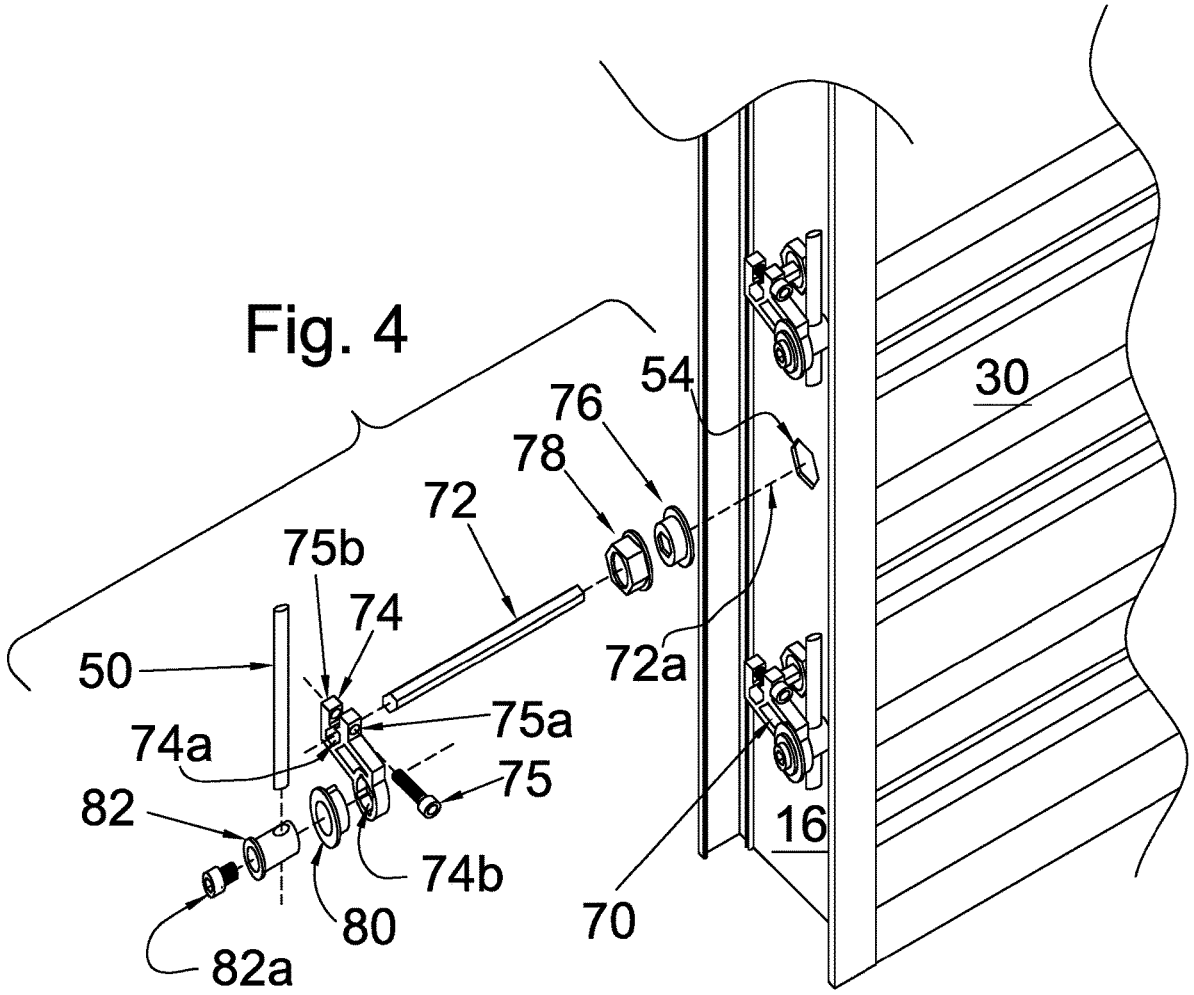
FIG. 4 is a partial perspective exploded view of a crank arm linkage assembly for a damper blade of the backdraft damper of FIG. 1A.

In this embodiment, each blade 30A, 30B, 30C and 30D (referred to herein collectively as blade 30 where common features are being described) is similar to the blade disclosed in the above-noted '806 patent application referred to above. In particular, each blade 30 comprises a blade body 31 having a central portion 32 for connection to a linkage rod 50A, 50B, 50C via crank arm linkage assembly 70, illustrated in FIG. 4, for example formed from extruded aluminium or steel components. The crank arm linkage assembly 70 comprises a pivot pin 72 for insertion in press-fit engagement and/or for mechanically fastening into a pin channel 52 formed in the central portion 32, to rotationally lock the pivot pin 72 and the blade 30. The pivot pin 72 may be of any suitable shape and/or configuration, including hexagonal, octagonal, square and the like. In the illustrated example, the pivot pin 72 is hexagonal in the embodiment illustrated, and the pin channel 52 is formed with a complementary hexagonal profile to receive the pivot pin 72 in rotationally locked engagement.

In the preferred embodiment the pivot pin 72 is mounted via a dual bearing system, comprising a durable polymer proximal bearing 76, for example formed from a polyacetyl polymer such as Celcon (trademark), disposed over the portion of the pivot pin 72 projecting from the pin channel 52 and having a circular external profile. Alternatively, bearings 76 may be formed from a bronze oilite material, for example. The proximal bearing 76 is capped by a polycarbonate medial bearing 78 having a circular internal profile for slip-fit engagement over the proximal bearing 76, which permits free rotation between the proximal and medial bearings 76, 78. The proximal and medial bearings 76, 78 are disposed between the ends of the blade 30 and the sides 14, 16 of the frame and the pivot pin 72 extends beyond the proximal and medial bearings 76, 78 into a first opening 74*a* in the crank arm 74. The first opening 74*a* has a profile complementary hexagonal profile of the pivot pin 72, to receive the pivot pin 72 in rotationally locked engagement, which is secured in the first opening 74*a* by fastener 75 which clamps arms 75*a* and 75*b* together to close the opening 74*a* and trap the end of the pivot pin 72.

A durable polymer distal bearing 80, which may also be formed from a polyacetyl polymer such as Celcon (trademark) or the bronze oilite material referred to above or other suitable material, has a circular exterior profile for engagement in a second opening 74*b* in the crank arm 74, spaced from the first opening. The second opening has a circular profile for slip-fit engagement by the distal bearing 80. The internal profile of the distal bearing 80 is also circular, for receiving a trunnion bearing 82 through which the linkage rod 50 extends and is axially fixed by cup point fastener 82*a*. The medial bearing 78 is preferably fixed in the damper frame 16 via a hexagonal shaped hole. The pivot pin 72 is placed through the bearings 76 and 78 and then located into the first crank arm opening 74 a by a fastener 75.

Figure 5:
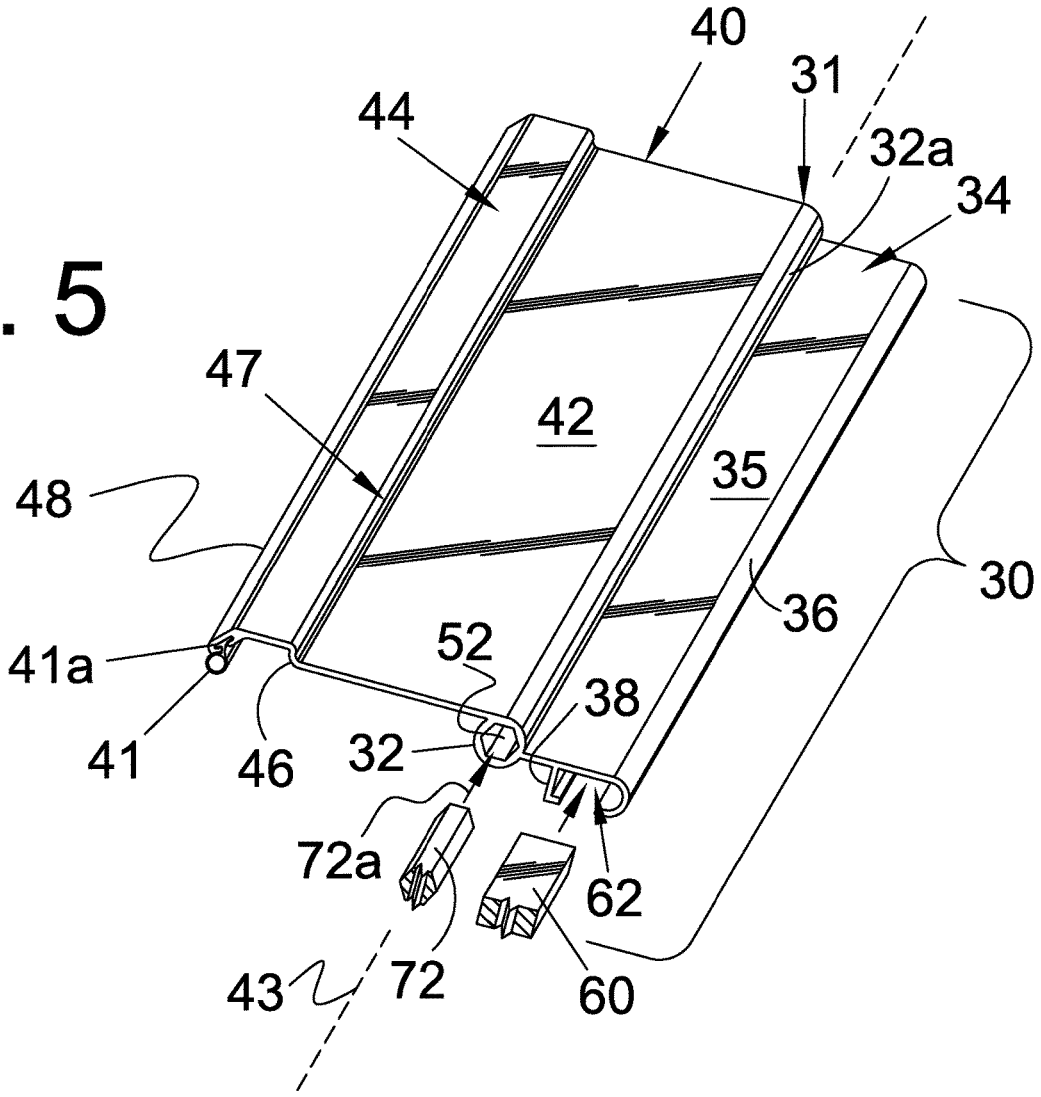
FIG. 5 is a perspective view of a bottom damper blade in the backdraft damper of FIG. 1A, shown from its bottom-facing side.

While a given pivot mechanism and linkages have been described, other attachment mechanisms may be used if they are configured to facilitate the desired operation of the blades 30 as described herein. Referring also to FIG. 5, the blades 30 in this embodiment extend along a blade axis 43 that is generally parallel to the rotation axis 72*a*.

Optionally, the blades 30 can be grouped into two or more sets or groups of blades that are configured to operate together and differently than lades in the other set. For example, two of the blades 30 can be configured to rotate in one direction, and two of the blades can be configured to rotate in the opposite direction, in contrast to conventional dampers in which the blades 30A, 30B, 30C and 30D would be configured to rotate in the same direction.

In the illustrated example, the blades 30A and 30B in damper 10 can be linked together and similarly configured so as to function as a top or first set of blades, which are pivotally mounted so as to rotate within the frame in a first closing direction (arrow 27) when moving from their open position (FIG. 1A, 2A), in which they allow air to flow through frame 12, to their closed position (FIG. 1B, 2B) in which they impede air from flowing through frame 12.

Blades 30C and 30D can be linked together and similarly configured so as to function as a bottom or second set of blades, which are pivotally mounted so as to rotate within the frame 12 in a closing second direction (arrow 29) that is opposite the first closing direction, when moving from their open position (FIG. 1A, 2A), in which they allow air to flow through frame 12, to their closed position (FIG. 1B, 2B) in which they impede air from flowing through frame 12. In this sense, blades 30A and 30B open and closed in an opposed configured to blades 30C and 30D. For example, when viewed from side 14 in FIGS. 1A and 1B, blades 30A and 30B will rotate clockwise when moving from their open configuration to their closed configuration, whereas blades 30C and 30D will rotate counter-clockwise when moving from their open configuration to their closed configuration. In this arrangement, when the blades 30 are opening blades 30B and 30C can be considered to be rotating away from each other and can be considered to rotate toward each other when closing. When in the open position as shown in FIG. 1A, blades 30B and 30C are spaced apart from each other by a blade offset distance 51, and also serve to bound the upper and lower sides of one example of an intermediate flow region 33. In this example, the intermediate flow region 33 is partially bounded by a blades 30B from the first set of blades and blade 30C from the second set of blades, and has a height 35 that is equal to a blade offset distance between the blades.

In this example, blades 30B and 30C are connected such that the portions of the blades that rotate toward each other are relatively longer than the other portions of the blades, as described herein. In this arrangement, the height/blade offset distance 51 is greater than the length 37 of either one of the blades 30B and 30C, and than any of the other blades in the first and second sets of blades.

In this arrangement, the intermediate flow region 33 is located toward the centre of the frame 12 and is relatively free from obstruction as none of the blades or blade mounting hardware project into the intermediate flow region 33 when the blades 30B and 30C are in their open configuration.

It will be appreciated that the blades 30 merely need to be pivotable between the opened and closed positions, so the rotational locking of the pivot pin 72 to the pin channel 52 is optional (but may assist in reducing noise and/or wear on the blade 30).

As shown in FIG. 5, which is a perspective view of one of the bottom (second) damper blades 30C or 30D shown from its bottom-facing side, the blade body 31 further comprises a leading portion 34 upstream of the central portion 32 (relative to the outflow direction of the damper 10). Optionally, at least some of the blades 30 may also include a receiving portion that can be configured to receive a counterweight material, which can be added or removed from the blade to alter its balance as described herein. The counterweight receiving portion can be of any suitable configuration, and may include a groove, hole, aperture, channel, fastener and the like. The counterweight receiving portion may be provided at any suitable location on the blade body 31, and preferably is provided toward one of the ends/tips of the blade to take advantage of the relatively longer moment arm that is created. Optionally, the counterweight receiving portion may be configured so that the counterweight material can be at least partially, and optionally entirely nested within the blade body 31, and therefore less likely to alter the outer shaped of the blade and/or alter its air flow characteristics. This may also help prevent fouling of the counterweight receiving portion, and/or may help reduce the chances of the counterweight material becoming dislodged from the blade and falling into the damper 10 or air flow passage.

In the illustrated example, the blades 30C and 30D has a counterweight receiving portion that includes a channel 62. In this embodiment the leading portion 34 of the blade body 31 comprises a planar section 35 merging into the wall of a channel 62 for receiving a counterweight 60, that includes a generally elongate bar of a sufficiently heavy material (such as metal, plastic or the like).

In the preferred embodiment the leading edge 36 of the leading portion 34 is rounded, forming a bullnose profile that reduces the formation of eddies and currents as the air flows past the blade 30. Thus, the part of the leading portion 34 forming the leading face of the channel 62 for the counterweight 60 can be formed as a bullnose. This diminishes friction and thus resistance to the airflow, in turn reducing the pressure and velocity required for operation and pressure losses downstream of the damper 10. The other side of the channel may be formed by a generally "L"-shaped flange 38 depending from the planar section 35 of the leading portion 34. These features are readily formed by extrusion and allow the counterweight 60 to be inserted into the blade body 31 from the side.

While the channel 62 may include an open area on one side, the counterweight 60 is, in this embodiment, substantially nested within the body 31 of the blade 30 and sheltered from the air flow.

Also in this example, the counterweight 60 is insertable or removable from the channel 62 by sliding it in the axial direction (parallel to pin 72). When the blade 30 is installed in the damper 10, its sides may be obstructed by the sides 14 and 16 of the frame 12. This may help inhibit insertion or removal of the counterweight 60 into or out of the channel 62 while the blade 30 is in use.

Optionally, the counterweight 60 may include two or more pieces that are independently insertable or removable from the channel 62. This may help adjust the counterweight, and the resulting moment forces, for a given blade 30.

In preferred embodiments the planar section 35 of the leading portion 34 is transversely offset from the axis 72*a* of the pivot pin 72. This results in an arcuate occlusion at the central portion 32 which allows for the formation of a static head upstream of the central portion 32 both above and below the planar section 35 of the leading portion 34 of the blade 30. As described in the above-note '806 patent application, the static head acts to smooth out the airflow above the blades 30A, 30B (and below the blades 30C and 30D) in the open position, reducing resistance to the airflow and thus reducing pressure losses downstream of the damper 10.

The blade body 31 further comprises a trailing portion 40 downstream of the central portion 32. The trailing portion 40 of the blade body 31 provides a seal 41, for example a silicone bubble gasket having a spline lodged (for example crimped) in a slot 41*a* extending across the distal edge of the trailing portion 40. In the case of blades 30A and 30D, the seal 41 seals against the planar section 35 of the leading portion 34 of an adjacent blade 30B and 30C, respectively. In the case of the intermediate blades 30B and 30C, the seals 41 meet in the middle of the airflow region to prevent backflow in the closed position shown in FIGS. 1A and 2B. In an embodiment, there is a support (not shown in FIGS. 1A, 1B, 2A and 2B) affixed to frame 12 for also meeting with seals 41 (as shown in the embodiment of FIGS. 7A, 7B, 7C and 7D) thereby to stop intermediate blades 30B and 30C from respectively rotating further once in the closed position. The stronger the backflow the more pressure is exerted against each trailing portion 40, which has a significantly larger surface area than the leading portion 34, increasing the effect of the seal 41.

Figure 6:
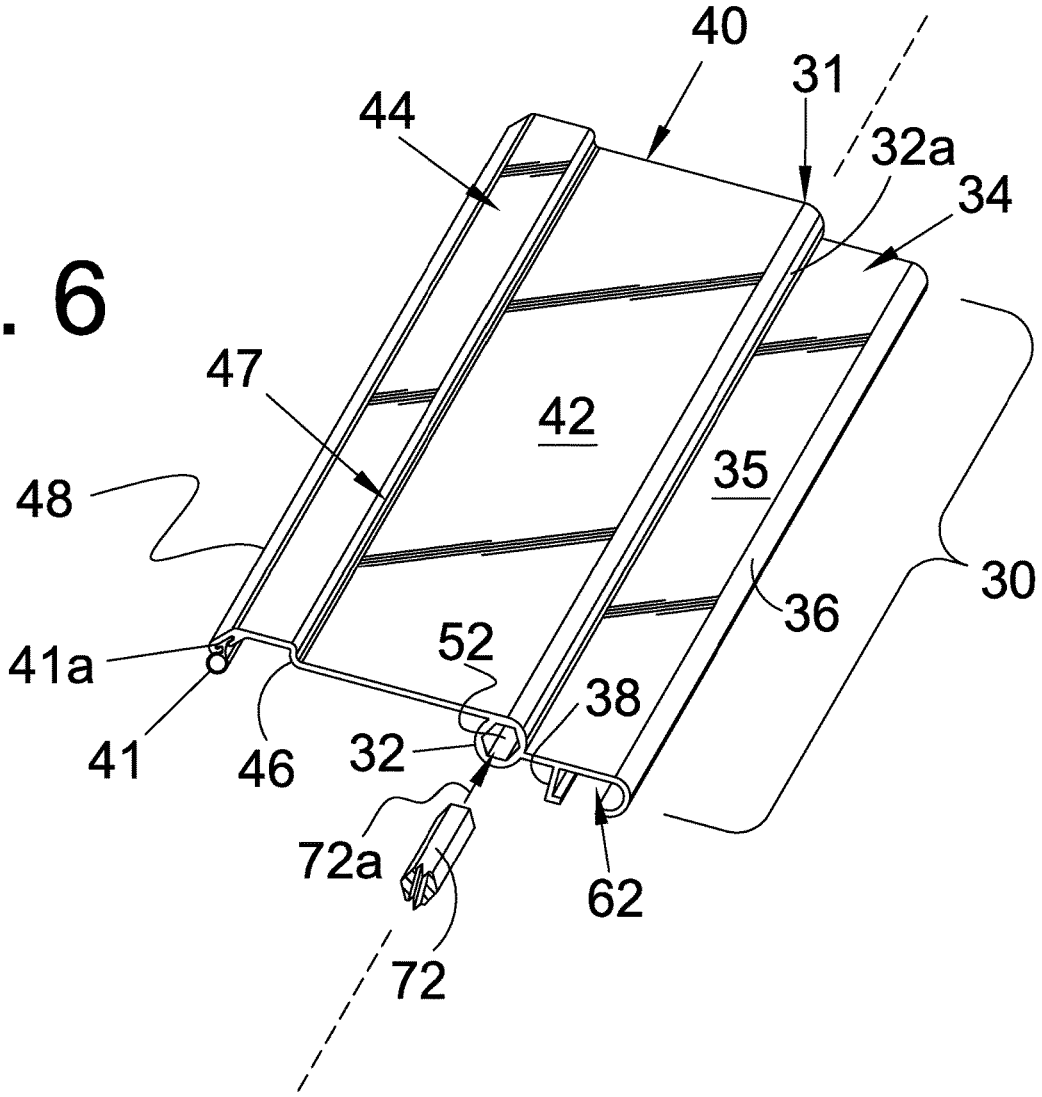
FIG. 6 is a perspective view of a top damper blade in the backdraft damper of FIG. 1A.

FIG. 6 is a perspective view of one of the top (or first) damper blades 30A, 30B shown from its top-facing side. In this embodiment, blades 30A and 30B are the same as blades 30C and 30D, except as described above they are coupled with frame 12 to rotate in the opposite direction as do blades 30C and 30D, and furthermore blades 30A and 30B do not receive counterweights 60.

As for bottom/second blades 30C and 30D, the heavier the counterweight 60, the closer the counterweight 60 may be disposed to the pivot pin 52 in order to properly balance the blades 30C and 30D to be slightly gravitationally biased to the closed position shown in FIGS. 1B and 2A, accounting for their influence on non-counterweighted top/first blades 30A and 30B via a linkage rod 50C, as will be described. This keeps the surface area of the leading portion 34 small relative to the surface area of the trailing portion 40, which both reduces the pressure required to pivot the blades 30 to the open position shown in FIGS. 1A and 2B and ensures that a backdraft airflow forces the blades 30 more tightly into the closed position, rather than toward the open position.

The trailing portion 40 is similarly preferably transversely offset from the axis of the pivot pin 72, on the opposite side of the pivot pin 72 from the leading portion, which allows for the formation of a static head immediately downstream of the central portion 32 of the blade 30. The trailing portion 40 is preferably provided with a generally planar portion 42 extending from the central portion 32, and a lateral depression 44 open opposite to the direction of the offset of the trailing portion 40 from the central portion 32, adjacent to the distal edge of the trailing portion 40. The lateral depression 44 may be formed essentially as a return flange, for example by upward bend 46, downstream bend 47 and downward bend 48.

The lateral depression 44 allows for the creation of a static head below the trailing portion 40 of blades 30A and 30B (above the trailing portion of blades 30C and 30D), as described in the above-noted '806 patent application. Similar to the upstream static head formed by the surface 32A of the central portion 32, which acts to smooth out the airflow above the blades 30A, 30B (below the blades 30C, 30D), this downstream static head acts to smooth out the airflow below the blades 30A, 30B (above the blades 30C, 30D) in the open position, reducing resistance to the airflow and thus reducing pressure losses downstream of the damper 10. The downstream static head formed beneath the lateral depression 44 of blades 30A and 30B (and above the lateral depression 44 of blades 30C and 30D) also provides a buffer zone beneath (above) the lateral depression 44 that helps to keep the blade 30 in the fully open position when air is flowing through the frame 12.

Figure 3:
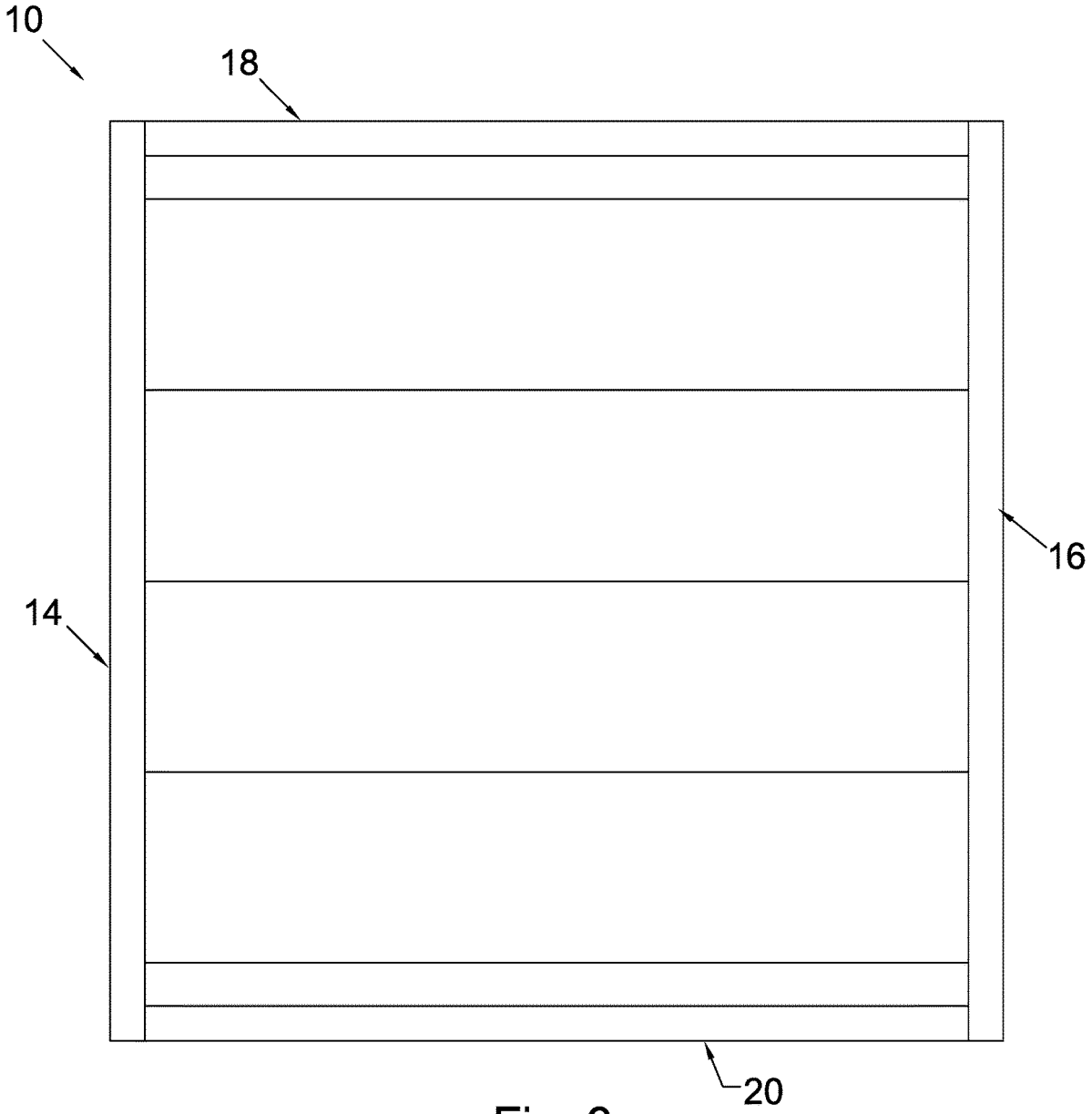
FIG. 3 is a front elevation view of backdraft damper of FIG. 1A, in closed position.

The damper 10 is mounted vertically into a structure with the leading portions 34 of the blades 30A, 30B at the top and the leading portions 34 of the blades 30C, 30D in the closed position shown in FIGS. 1B, 2A and 3, which is the rest position of the blades 30 under the influence of gravity without any airflow. When air starts to flow in the desired direction, shown by the arrows in FIGS. 1A and 2B, a uniform downstream pressure is exerted against the blades 30, but because the surface area of each trailing portion 40 is much larger than the surface area of each leading portion 34, the greater force of the airflow against the trailing portion 40 overcomes the influence of gravity and forces the blades 30 to pivot to the open position shown in FIGS. 1A and 2B.

As blades 30A and 30B pivot the rotational interlock between the pin channel 54 and the pivot pin 72 rotates the crank arm 74, which moves the linkage rod 50A between blades 30A and 30B. Similarly, as blades 30C and 30D pivot their crank arms 74 rotate, which moves the linkage rod 50B between blades 30C and 30D.

In the opposed linkage configuration shown in FIGS. 2A and 2B, the two facing blades 30B and 30C that are adjacent and configured to rotate in opposite directions from each other in order to move from their respective closed positions to their respective open positions (clockwise and counter clockwise, respectively) and vice versa, influence each other through linkage rod 50C and their respective crank arms 74 to rotate in their opposite directions. As such, blades 30C and 30D being counterweighted serve, via linkage rod 50C, to enable each other and blades 30A and 30B to all open quickly with little resistance when airflow begins. This permits installations in which a fan can run at a slower speed, thus saving energy. This may also help the air flowing through the damper 10 to continue flowing in the generally axial air flow direction, as compared to being generally directed downwardly and or upwardly by convention, one-direction damper vane arrangements. This may also help facilitate more air flow through the center portion of the damper 10 (e.g. through the intermediate flow region 33) which may help accommodate a relatively higher airflow through the damper 10 while utilizing a lower fan speed. On the other hand, blades 30A and 30B not being individually counterweighted serve, via linkage rod 50C, to quickly move blades 30C and 30D to their closed position once airflow stops, under the influence of their heavier, non-counterweighted trailing portions.

The combination of the distance of the counterweight 60 from the fulcrum provided by the pivot pin 72 in bottom blades 30C and 30D, and the weights of the counterweights 60 themselves, are selected to so as to maintain a slight bias of the entire damper 10 toward the closed position while allowing the airflow to overcome the influence of gravity at relatively low pressures.

For example, by varying the configuration of the blades, and by adding optional counterweights, the balance of a given blade around its pivot pin 72 can be modified. A blade can be considered balanced if, in the absence of air flow or another external force, it tends to remain still and/or not rotate. A blade that is balanced in this way would tend to remain in a given orientation until purposefully adjusted and/or subjected to an air flow of sufficient force. In practice, balanced blades of this nature may tend to be rotated open by air flowing through the damper (which exerts a force on the blades) but may then tend to remain open when the airflow stops—as the gravitational forces acting on each side of the blade are approximately equal (i.e. there is no material net moment acting on the blade about pivot pin 72).

Further, a balanced blade of this manner may tend to be relatively easier to rotate about its pivot pin 72 (or other suitable axis) because its net moment force is relatively low, and can tend to be overcome by an applied force, relatively low energy air flow and the like. In such configurations, the moment force $M_1$ shown in FIG. 2B may be relatively low and may be approximately zero.

If a damper is intended to self-opening in response to an air flow, having balanced blades of this nature may be desirable as they may tend to open relatively easily. However, if the damper is intended to be self-closing under the influence of gravity, having balanced blades of this nature may be undesirable as they may tend to remain open, and not automatically rotate back toward a closed position under the influence of gravity.

In contrast, blades that are unbalanced can be understood to mean blades in which the net moment force acting about their pivot pin 72 (or other suitable axis), in the absence of external loading, is large enough to cause the blade to rotate about its pivot axis. For example, when an unbalanced blade is in the open configuration it may be subjected to a net moment force urging it to rotate toward its closed position under the influence of gravity. In such configurations, the moment force $M_2$ shown in FIG. 2B may be relatively high and may be sufficient to urge the blade 30C to rotate downwardly toward its closed position (FIG. 2A)

Absent a counteracting force (such as the air flow, or force transferred from the upper blades 30A and 30B as described herein etc.) the unbalanced blade may tend to auto-rotate as a result of the moment force $M_2$ when the air flow stops. Such blades may be considered auto-closing. However, blades that are unbalanced, and biased toward the closed position, may be relatively more difficult to open than balanced blades, and may require more air flow and/or a higher air pressure in order to be opened.

Optionally, to utilize a combination of these attributes, a damper may be configured to include blades that are differently balanced, with some blades being relatively more balanced, and some blades being relatively less balanced and/or unbalanced. This may allow some blades to be relatively easy to open (the balanced blades) and some blades to be considered auto-closing and biased to rotate toward their closed position (the unbalanced blades). Preferably, some of the balanced blades may be mechanically or otherwise functionally linked to some of the unbalanced blades, such that they can rotate together, and preferably in unison with each other. This may help balance the overall operation of the damper.

For example, when linked together as shown in FIGS. 1A-2B (such as by a linkage or other apparatus) air flowing through the damper 10 may exert an opening force on both the balanced (30A and 30B) and unbalanced (30C and 30D) blades, and the linkages 50 may help transfer some of the net opening force/moment acting on the balanced blade (30A and/or 30B) to the unbalanced blade (30C and/or 30D) to assist in overcoming its closing, biasing moment $M_2$. This may help facilitate opening the linked blades at an air pressure/flow rate that is more than would be required to open the balanced blade(s) (30A and/or 30B) on its own, but less than would be required to open the unbalanced blade(s) (30C and/or 30D) on its own. Similarly, when the air flow stops, the net closing biasing force acting on the unbalanced blade (moment $M_2$) may also act on the balanced blade(s), so that as the unbalanced blade rotates closed it can overcome any opposing moment exerted by the balanced blades (such as $M_1$) and cause the balanced blade(s) to also rotate closed. This may help facilitate the auto-closing of the overall damper 10 having mixed types of blades.

A given blade may be configured to be a balanced or unbalanced blade my modifying its design and/or by adding counterweights (including counterweight 60 described herein) or other such material to appropriate regions of the blades. The biasing force for an unbalanced blade may also, in some circumstances, be applied by an external actuator or biasing member (i.e. a member that is not mounted on and movable with the blade itself)

Optionally, each of the blades in the damper 10 may configured to have the same, or at least substantially identical, configuration and/or cross-sectional shape. This may allow the blade members to be generally interchangeable with each other, which may help facilitate manufacturing, assembly and/or repair of the damper as common blades can be utilized. This may also help facilitate similar air flow characteristics as the air flows over each blade.

Optionally, the main portions/bodies of a given blade may be constructed to be relatively balanced but include a region for receiving a suitable counterweight member (e.g. channel 62). This may allow any given blade to be utilized as a balanced blade (with no or relatively little counterweight added) or configured as an unbalanced blade (with sufficient counterweight added to bias the blade toward its closed position). The counterweight members may be insertable on-site, where a damper 10 is being assembled, which may allow an installer to vary the attributes of a given blade in response to the specific conditions it is expected to experience.

The counterweight materials may be removable and may be provided in varying weights, which may allow an installer to re-configure a given unbalanced blade to adjust the magnitude of its biasing force by adjusting the mass of counterweight that is provided. While embodiments have been described in which each blade in a lower set of blades is counterweighted and each blade in a the upper set of blades is not counterweighted, alternatives are possible. For example, the principal underlying the opposed blade operation described herein is to achieve a first set of blades on one side of linkage 50C that is less counterweighted than a second set of opposed opening (closing) blades on the other side of the linkage 50C. This enables achievement of a less-balanced lower set of blades that will be therefore slightly comparatively heavier on their trailing portions than on their leading portions, biasing the lower set of blades to the closed position, and a more-balanced upper set of blades that will therefore be less comparatively heavier on their trailing portions than on their leading portions, whereby the moment forces or biasing effects of the upper set of blades to be overridden by the forces exerted by the lower set of blades to provide a sufficient closing force (such as moment $M_2$) that is capable of biasing all of the connected blades to their closed position in the event of no airflow or in the event of reverse airflow through the damper 10.

An implementer/installer may change the relative counterweighting of the lower set of blades depending on the application thereby to create resistance to opening of the blades under airflow. For example, there may be a desire to keep a specific and constant back pressure on one side of the damper—such as in the example of a positive-pressure stairwell—that can be accomplished using adjustable counterweights.

Figure 7A:
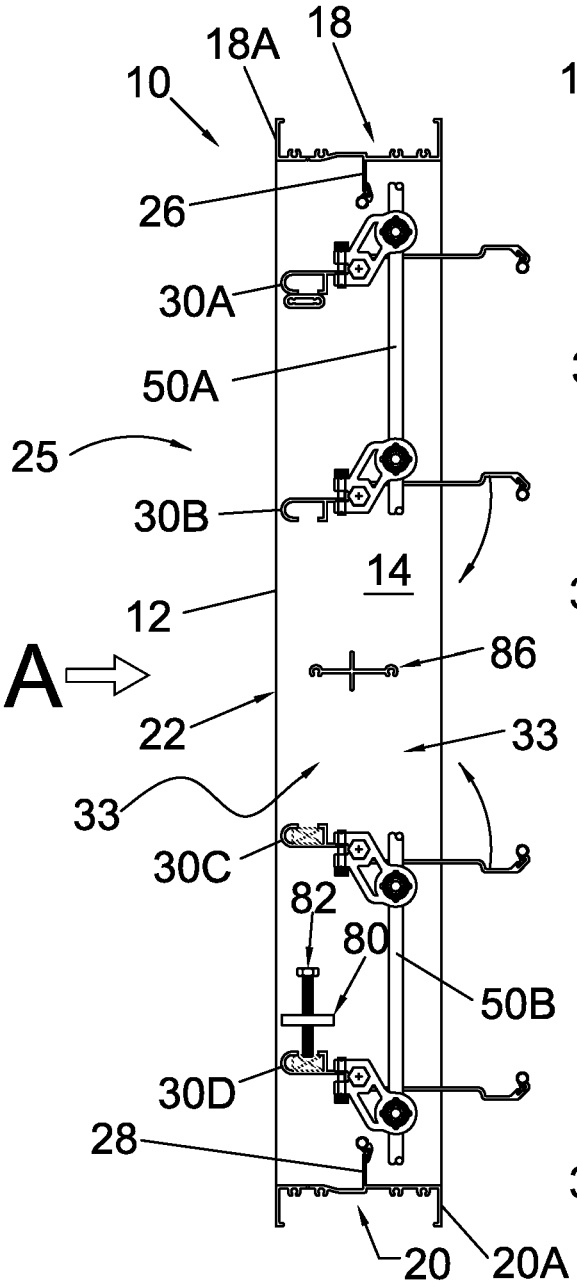
FIG. 7A is a first side view of a backdraft damper according to an alternative embodiment of the invention, shown in open position.
Figure 7B:
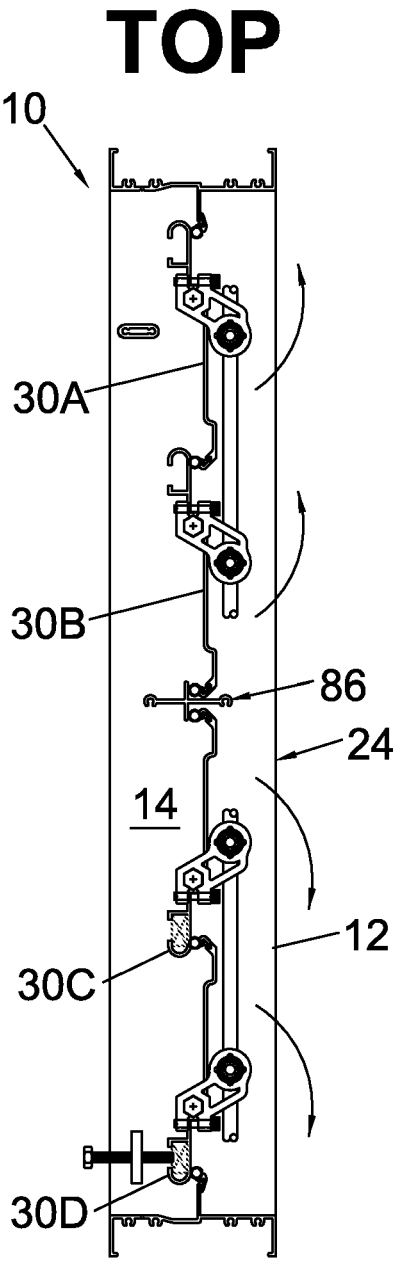
FIG. 7B is a first side view of the backdraft damper of FIG. 7A, shown in closed position.
Figures 8A, 8B:
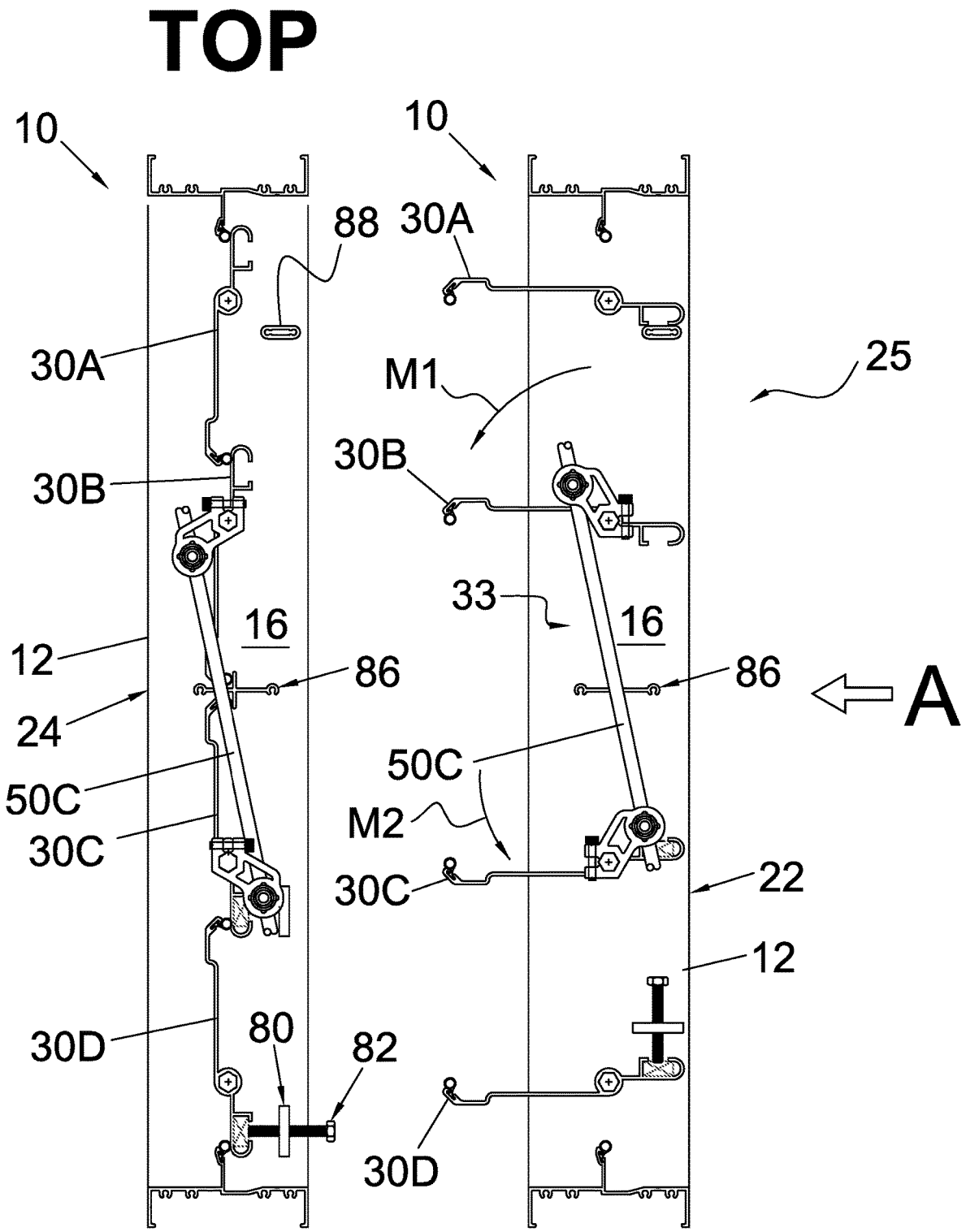
FIG. 8A is a second side view of the backdraft damper of FIG. 7A, shown in closed position.
FIG. 8B is a second side view of the backdraft damper of FIG. 7A, shown in open position.

In some embodiments, it may be advantageous For example, FIG. 7A is a first side view of a backdraft damper 10 according to an alternative embodiment of the invention, shown in open position, FIG. 7B is a first side view of the backdraft damper of FIG. 7A, shown in closed position, FIG. 8A is a second side view of the backdraft damper of FIG. 7A, shown in closed position; and FIG. 8B is a second side view of the backdraft damper of FIG. 7A, shown in open position. In this example, each of blades 30C and 30D is provided with an, optional, adjustable counterweight system that includes a weight support member and a movably and/or detachable weight. In this configuration, the weight support members comprise bolts 80 extending from the leading portion of the blades 30C and 30D onto which with adjustable counterweights 82 can be mounted. The counterweights 82 can be threaded at selected positions along the bolts to provide an optional adjustable counterweight thereby to enable an implementer/installer to make fine adjustments to the counterweighting according to the specific application and expected airflow pressures. It will be understood that in alternative embodiments and depending upon the implementation, only one of blades 30C and 30D may be provided with a corresponding counterweight assembly, such as the illustrated bolt 80 and counterweight 82 combination.

Optionally, the damper 10 may include one or more stop or support members that can limit the rotation of the blades in one, or optionally both, directions. For example, an open stop member may be provided to contact the blades when they reach their desired open configuration (FIGS. 1A, 2B, 7A and 8B) and to prevent over-rotation beyond that point. Similarly, closing stops can be provided so as to contact the blades when they reach their desired closed configuration (FIGS. 1B, 2A, 7B and 8A). In some arrangements, a common support or stop member may be used to engage two or more blades, and may, for example engage one or more blades from each of the upper and lower blade sets. The blade support/stops may be of any suitable shape and configuration, and optionally may be configured to help seal against a portion of the blade (for example when the blades are in the closed position) to help inhibit air flow through the damper when the blades are closed.

For example, as shown in the embodiment of FIGS. 7A, 7B, 7C and 7D is a centre bald support 86 is positioned for stopping the rotation of the respective trailing ends of opposed blades 30B and 30C by their seals 41, once the opposed blades 30B and 30C have reached their closed positions. Open stop members 88 can be provided in other locations to prevent over rotation of the blades in the open position. As the blades 30A-30D are mechanically linked to rotate together, stopping one blade (30A) can also prevent over-rotation of the other blades (30B-30D).

What has been described above has been intended to be illustrative of the invention and non-limiting and it will be understood by the persons skilled in the art that other variants and modifications may be made without departing from the scope of the invention as defined by the claims appended hereto. The scope of the claims should not be limited by the preferred embodiments and examples, but should be given the broadest interpretation consistent with the description as a whole.

Various embodiments of the present invention having been thus described in detail by way of example, it will be apparent to those skilled in the art that variations and modifications may be made without departing from the invention. The invention includes all such variations and modifications as fall within the scope of the appended claims.

The invention claimed is:

1. A backdraft damper for permitting a flow of air in an outward flow direction and preventing the flow of air in a backdraft direction, comprising:

a frame having a transverse opening allowing air to pass through the frame;

a plurality of blades configured to rotate between an open position in which the blade allows air to flow through the frame and a closed position in which the plurality of blades blocks air from flowing through the frame, the plurality of blades comprising one or more first blades arranged to rotate in a first direction from the closed position to the open position and one or more second blades arranged to rotate in a second direction opposite to the first direction from the closed position to the open position;

a counterweight associated with each of the one of more second blades; and a linkage between the one or more first blades and the one or more second blades to cause the first and second blades to together rotate between the closed and open positions and wherein the plurality of blades are movable from the closed position to the open position by a force of air flowing through the frame in the outward flow direction.

2. The backdraft damper of claim 1, wherein each blade in the plurality of blades extend across the frame and is mounted to the frame about a central portion by pivot members, and wherein the plurality of blades are biased toward the closed position.

3. The backdraft damper of claim 2, wherein the one or more second blades being more balanced about respective pivot members than the one or more first blades thereby permitting the one or more first blades to bias the one or more first blades and the one or more second blades to the closed position.

4. The backdraft damper of claim 1, wherein the one or more second blades are arranged below the one or more first blades in the frame.

5. The backdraft damper of claim 1, wherein the one or more second blades comprises a plurality of second blades, wherein a counterweight is associated with only one of the second blades.

6. A backdraft damper for permitting a flow of air in an outward flow direction and preventing the flow of air in a backdraft direction:

a) a frame having an interior that is bounded by a first end, a second end spaced from the first end and opposing side panels extending between the first and second ends, the frame defining an air inlet and an air outlet spaced apart from the air inlet in the outward flow direction;

b) an airflow region extending between the air inlet and air outlet;

c) one or more first blades positioned in the airflow region and rotatable relative to the frame in a first rotation direction from an open position in which the one or more first blades allow air to flow through the frame and a closed position in which the one or more first blades inhibit airflow through the airflow region from flowing through the frame;

d) one or more second blades positioned in the airflow region and rotatable in a second rotation direction an open position in which the one or more second blades allow air to flow through the frame and a closed position in which the one or more second blades inhibit airflow through the airflow region from flowing through the frame, the second rotation direction being different than the first rotation direction, each of the first blades extends along a first blade axis and is pivotally mounted to the frame within the airflow region about a first pivot axis, and wherein each of the second blades is pivotally mounted to the frame within the airflow region and about a second pivot axis, and at least one of the second blades being weighted so as to be biased to rotate toward its closed position, and wherein each of the first blades are configured to produce a first moment about its respective first pivot axis, and wherein at least one of the second blades is configured to produce a second moment about its respective second pivot axis that is greater than the first moment; and e) a linkage between the one or more first blades and the one or more second blades to cause the first and second blades to rotate in unison with each other between the respective closed and open positions.

7. The damper of claim 6, wherein a first one of the first blades extends along the first blade axis and has a first blade length that is orthogonal to the first blade axis, wherein when the first blades and second blades are in their respective open positions the first one of the first blades is spaced apart from an adjacent one of the second blades by a blade offset distance that is greater than the first blade length.

8. The damper of claim 6, wherein, when the first blades and second blades are in their respective open positions, an intermediate flow region is defined between the first one of the first blades and the adjacent one of the second blades, the intermediate flow region being substantially unobstructed by the first blades and second blades and having a height in a direction orthogonal to the first blade axis and first blade length that is substantially equal to the blade offset distance.

9. The damper of claim 6, wherein when the first blades are in a partially open position between the open position and the closed position air flowing through the damper is re-directed in a first flow direction by the first blades, and wherein when the second blades are in a partially open position between the open position and the closed position air flowing through the damper is re-directed in a second flow direction by the second blades that is different than the first flow direction.

10. The damper of claim 9, wherein when the first blades are in a partially open position between the open position and the closed position air flowing in the first flow direction flows generally toward the second blades.

11. The damper of claim 9, wherein the frame defines a central air flow axis that is parallel to the outward flow direction and wherein when the first blades are in a partially open position between the open position and the closed position air flowing in the first flow direction flows generally toward the central flow axis.

12. The damper of claim 11, wherein when the second blades are in a partially open position between the open position and the closed position air flowing in the second flow direction flows generally toward the central flow axis.

13. The damper of claim 9, wherein air travelling in the first flow direction converges with air travelling in the second flow direction at a location that is either within the intermediate flow region or downstream from the damper, thereby forming a composite air flow travelling substantially in the outward flow direction.

14. The damper of claim 6, wherein the first blades and second blades each comprise a blade body portion having the same, extruded cross-sectional shape.

15. The damper of claim 14, wherein the first blades and the second blades each comprise a counterweight receiving portion that is integrally molded into the blade body portion, and wherein a counterweight member is provided in the counterweight receiving portion of at least one of the second blades.

* * * * *